US005270762A

United States Patent [19]

Rosenburgh et al.

[11] Patent Number: 5,270,762

[45] Date of Patent: Dec. 14, 1993

[54] SLOT IMPINGEMENT FOR A PHOTOGRAPHIC PROCESSING APPARATUS

[75] Inventors: John H. Rosenburgh, Hilton; David L. Patton, Webster; Ralph L. Piccinino, Jr., Rush, all of N.Y.; Anthony Earle, London, England

[73] Assignee: Eastman Kodak Company, Rochester, N.Y.

[21] Appl. No.: 844,355

[22] Filed: Mar. 2, 1992

[51] Int. Cl.[5] ..... G03D 3/02

[52] U.S. Cl. ..... 354/324

[58] Field of Search ..... 354/324, 319-321, 354/325, 317, 318

[56] References Cited

U.S. PATENT DOCUMENTS

| | | | |
|---|---|---|---|
| 1,223,664 | 4/1917 | Brewster | 354/317 |
| 2,248,056 | 5/1939 | Blaney | 354/321 |
| 2,614,472 | 10/1952 | Luboshez | 354/325 X |
| 2,892,394 | 6/1959 | Hixon et al. | 354/328 X |
| 3,180,243 | 4/1965 | Siskind et al. . | |
| 3,372,630 | 3/1968 | Schimdt | 354/324 |
| 3,528,760 | 9/1970 | Buechner | 354/324 |
| 3,538,835 | 11/1970 | Needleman | 354/324 |
| 3,601,029 | 8/1971 | Needleman | 354/324 |
| 3,604,331 | 9/1971 | Parlin | 354/324 |
| 3,774,521 | 11/1973 | Beck | 354/324 |
| 3,860,944 | 1/1975 | Huber | 354/324 |
| 3,877,805 | 4/1975 | Heldenbrand et al. | 354/325 |
| 3,886,575 | 5/1975 | Gall | 354/324 X |
| 3,916,426 | 10/1975 | Bown | 354/319 |
| 3,981,583 | 9/1976 | Tsuchida et al. | 354/325 X |
| 4,123,769 | 10/1978 | Fernandez et al. | 354/322 |
| 4,213,420 | 7/1980 | Martino | 354/325 X |
| 4,222,657 | 9/1980 | Leuchter | 354/324 |
| 4,248,513 | 2/1981 | Caccamisi | 354/331 |
| 4,295,730 | 10/1981 | Fraser | 354/325 |
| 4,327,987 | 5/1982 | Friar et al. | 354/317 |
| 4,332,455 | 6/1982 | Stetiner | 354/324 |
| 4,359,279 | 11/1982 | Popoff | 354/320 |
| 4,362,377 | 12/1982 | Yoshida et al. | 354/324 X |
| 4,371,250 | 2/1983 | Wakabayashi et al. | 354/325 |
| 4,398,818 | 8/1983 | Jeromin et al. | 354/324 X |
| 4,428,659 | 1/1984 | Howard | 354/317 |
| 4,429,981 | 2/1984 | Frazier | 354/331 X |
| 4,464,035 | 8/1984 | Schoering | 354/322 X |
| 4,480,907 | 11/1984 | Vackier | 354/317 X |
| 4,687,313 | 8/1987 | Taniguchi et al. | 354/317 X |
| 4,688,917 | 8/1987 | Müller et al. | 354/320 X |
| 4,708,452 | 11/1987 | Schoen | 354/317 |
| 4,827,309 | 5/1989 | Kato | 354/317 X |
| 4,837,593 | 6/1989 | Hehn | 354/317 X |
| 4,839,683 | 6/1989 | Kushima et al. | 354/322 |
| 4,853,727 | 8/1989 | Ganzke et al. | 354/319 |
| 4,888,608 | 12/1989 | Kümmerl | 354/322 X |
| 4,902,608 | 2/1990 | Lamb et al. | 354/320 X |

(List continued on next page.)

FOREIGN PATENT DOCUMENTS

| | | |
|---|---|---|
| 1029674 | 5/1958 | Fed. Rep. of Germany . |
| 243782 | 11/1987 | Fed. Rep. of Germany . |
| 4428034 | 11/1969 | Japan . |
| 102123 | 11/1979 | Japan . |
| 2048661 | 2/1990 | Japan . |
| 2-79844 | 3/1990 | Japan . |
| 129637 | 5/1990 | Japan . |
| 3-59655 | 3/1991 | Japan . |
| 451981 | 3/1973 | U.S.S.R. . |
| 965387 | 3/1963 | United Kingdom . |
| 1411343 | 10/1975 | United Kingdom . |
| 764412 | 12/1987 | United Kingdom . |
| 8713117 | 12/1987 | United Kingdom . |

*Primary Examiner*—D. Rutledge

*Attorney, Agent, or Firm*—Ronald Reichman

[57] ABSTRACT

An apparatus for processing photosensitive materials, which comprises: a tank through which a processing solution is pumped; a rack having integral means to facilitate its insertion and removal from the tank, the rack and the tank are relatively dimensioned so that a small volume for holding processing solution and photosensitive material is formed between the rack and the tank; means for circulating the processing solution through the small volume; and one or more slot nozzles coupled to the circulating means and located in the wall of the tank for controlling the velocity and amount of processing solution that dynamically impinges on the surface of the photosensitive material.

11 Claims, 8 Drawing Sheets

U.S. PATENT DOCUMENTS 4,929,974 5/1990 Sakamoto et al. ..... 354/324 X
4,969,002 11/1990 Nakayama ..... 354/325
4,972,219 11/1990 Yamada et al. ..... 354/322
4,987,438 1/1991 Goto et al. ..... 354/324 X
4,989,028 1/1991 Hall et al. ..... 354/324
4,994,840 2/1991 Hall et al. ..... 354/324
5,023,644 6/1991 Kurematsu et al. ..... 354/320
5,034,767 7/1991 Netz et al. ..... 354/319
5,055,870 10/1991 Ohba et al. ..... 354/324 X
5,075,711 12/1991 Ohba ..... 354/320
5,079,580 1/1992 Wada ..... 354/319 X

SLOT IMPINGEMENT FOR A PHOTOGRAPHIC PROCESSING APPARATUS

CROSS REFERENCE TO RELATED APPLICATIONS

Reference is made to commonly assigned copending patent applications: Ser. No. 07/844,820 entitled "A DRIVING MECHANISM FOR A PHOTOGRAPHIC PROCESSING APPARATUS" filed herewith in the names of Ralph L. Piccinino, Jr., David L. Patton, Roger E. Bartell, Anthony Earle, and John Rosenburgh, U.S. Pat No. 5,179,404 entitled "ANTI-WEB ADHERING CONTOUR SURFACE FOR A PHOTOGRAPHIC PROCESSING APPARATUS" filed herewith in the names of Roger E. Bartell, Ralph L. Piccinino, Jr., John H. Rosenburgh, Anthony Earle, and David L. Patton; Ser. No. 07/844,815 entitled "A RACK AND A TANK FOR A PHOTOGRAPHIC PROCESSING APPARATUS" filed herewith in the names of David L. Patton, Roger E. Bartell, John H. Rosenburgh and Ralph L. Piccinino, Jr., and Ser. No. 07/844,355 entitled "RECIRCULATION, REPLENISHMENT, REFRESH, RECHARGE AND BACK-FLUSH FOR A PHOTOGRAPHIC PROCESSING APPARATUS" filed herewith in the names of Roger E. Bartell, David L. Patton, John Rosenburgh, and Ralph L. Piccinino, Jr.

BACKGROUND OF THE INVENTION

1. Field of the Invention

The invention relates to the field of photography, and particularly to a photosensitive materials processing apparatus.

1. Description of the Prior Art

The processing of photographic film involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 lits of each processing solution. A small photofinishing apparatus or microlab utilizes tanks that may contain less than 10 liters of processing solution.

The chemicals contained in the photographic solution: cost money to purchase; change in activity and leach out or season during the photographic process; and after the chemicals are used the chemicals must be disposed of in an environmentally safe manner. Thus, it is important in all sizes of photofinishing apparatus to reduce the volume of processing solution. The prior art utilized various types of replenishing systems that add or subtract specific chemicals to the photographic solution to maintain a consistency of photographic characteristics in the material developed. It is possible to maintain reasonable consistency of photographic characteristics only for a certain period of replenishment. After a photographic solution has been used a given number of times, the solution is discarded and a new photographic solution is added to the tank.

Activity degradation due to instability of the chemistry, or chemical contamination, after the components of the photographic solution are mixed together causes one to discard the photographic solution in smaller volume tanks more frequently than larger volume tanks. Some of the steps in the photographic process utilize photographic solutions that contain chemicals that are unstable, i.e., they have a short process life. Thus, photographic solutions in tanks that contain unstable chemicals are discarded more frequently than photographic solutions in tanks that contain stable chemicals.

The prior art suggest, that if the volume of the various tanks contained within various sizes of photographic processing apparatus were reduced, the same amount of film or photographic paper may be processed, while reducing the volume of photographic solution that was used and subsequently discarded. One of the problems encountered by the prior art in using smaller volume tanks was that the inner and outer sections of the tank were fixed and not separable.

Another problem encountered by the prior art in using low volume tanks was that fresh processing solution had to be placed in the small space between the processing surfaces of the photosensitive material and the processing solution exiting wall of the processing chamber. If one just attempted to pump fresh processing solution between the wall of the processing chamber and the photosensitive material, the fresh processing solution would not migrate directly to the photosensitive material since the space was small and there was low chemical activity. Hence, the photosensitive material would not be developed properly. Thus, the prior art needed a way to introduce fresh processing solution between a wall and the surfaces of a photosensitive material.

Nozzles or holes were used by the prior art to distribute fresh processing solution in large volume processing tanks. However, if one used nozzles or holes to distribute fresh processing solution in small volume processing tanks, the photosensitive material would not be uniformly developed. The reason for the above is that when the fresh processing solution was distributed, the fresh processing solution was close to the photosensitive material and did not have space to uniformly spread out across the surfaces of the photosensitive material. If the distance between the nozzles or holes and the surface of the photosensitive material were increased to obtain adequate distribution of the fresh processing solution, one would no longer have a small volume tank.

Slots were not used by the prior art to distribute fresh processing solution in large volume tanks since the processing solution would not travel uniformly across a large volume of solution.

As the photosensitive material passes through the tank, a boundary layer is formed between the surfaces of the photosensitive material and the processing solution. The processing solution moves with the photosensitive material. Thus, the boundary layer between the photosensitive material and the processing solution has to be broken up to enable fresh processing solution to reach the photosensitive material. Rollers were used in large prior art tanks to break up the boundary layer. The roller squeegeed the exhausted processing solution away from the surfaces of the photosensitive material, thus, permitting fresh processing solution to reach the surfaces of the photosensitive material. One would not use rollers in small volume tanks, to break the boundary layer between the photosensitive material and the processing solution, since rollers require additional space and add to the volume of required processing solution.

Wire meshes were utilized by the prior art to break the boundary layer to uniformly distribute fresh processing solution across the surfaces of the photosensitive material. One of the difficulties encountered in using wire mesh was that the mesh would catch particulate matter which abrades the photosensitive material surfaces causing pressure sensitization and scratches. The mesh material also wears which causes a nonuniform reaction between the processing solution and the photosensitive material. Furthermore, the mesh must be cleaned or replaced.

SUMMARY OF THE INVENTION

This invention overcomes the disadvantages of the prior art by providing a low volume photographic material processing apparatus that introduces fresh processing solution uniformly across the surfaces of a photosensitive material. The processing apparatus utilizes a slot nozzle configuration, whose fluid distribution pattern meets or exceeds the width of the photosensitive material. The slot nozzle does not have to be periodically changed or cleaned and is designed in such a manner that an amount of fresh processing solution exits the slot nozzle at a sufficient velocity to disrupt the boundary layer of exhausted processing solution allowing fresh processing solution to reach the surfaces of the photosensitive material. The slot nozzle permits the velocity of the exiting processing solution to be varied by changing the pressure of the solution. Thus, controlling the amount of fresh processing solution reaching the surfaces of the photosensitive material. Hence, the chemical reaction between the photosensitive material and the fresh processing solution reaching the surface of the photosensitive material may be controlled.

Additional slot nozzles may be utilized to control the amount of chemical reaction between the fresh processing solution and the photosensitive material.

The foregoing is accomplished by providing an apparatus for processing photosensitive materials, which comprises: a tank through which a processing solution is pumped; a rack having integral means to facilitate its insertion and removal from the tank, the rack and the tank are relatively dimensioned so that a small volume for holding processing solution and photosensitive material is formed between the rack and the tank; means for circulating the processing solution through the small volume; and one or more slot nozzles coupled to the circulating means and located in the wall of the tank for controlling the velocity and amount of processing solution that dynamically impinges on the surface of the photosensitive material.

DESCRIPTION OF THE PREFERRED EMBODIMENT

Figure 1:
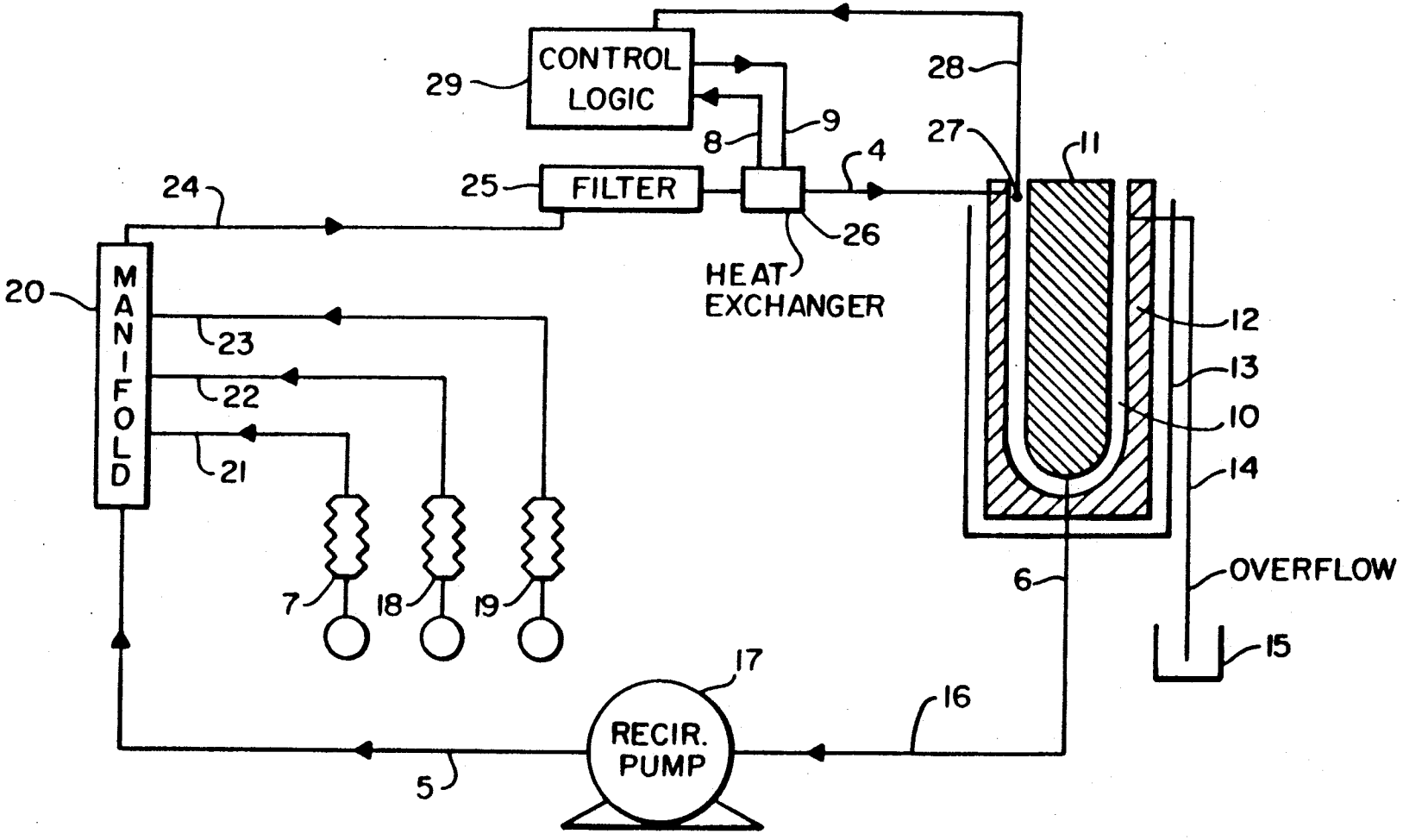
FIG. 1 is a schematic drawing of the apparatus of this invention.

Referring now to the drawings in detail, and more particularly to FIG. 1, the reference character 11 represents a rack 11, which may be easily inserted and removed from tank 12. Rack 11 and tank 12 form a low volume photosensitive material processing vessel 13.

When rack 11 is inserted in tank 12, a space 10 is formed. Rack 11 and tank 12 are designed in a manner to minimize the volume of space 10. The outlet 6 of vessel 13 is connected to recirculating pump 17 via conduit 16. Recirculating pump 17 is connected to manifold 20 via conduit 5 and manifold 20 is connected to filter 25 via conduit 24. Filter 25 is connected to heat exchanger 26 and heat exchanger 26 is connected to control logic 29 via wire 9. Control logic 29 is connected to heat exchanger 26 via wire 8 and sensor 27 is connected to control logic 29 via wire 28. Metering pumps 7, 18 and 19 are respectively connected to manifold 20 via conduits 21, 22 and 23.

The photographic processing chemicals that comprise the photographic solution are placed in metering pumps 7, 18 and 19. Pumps 7, 18 and 19 are used to place the correct amount of chemicals in manifold 20. Manifold 20 introduces the photographic processing solution into conduit 24.

The photographic processing solution flows into filter 25 via conduit 24. Filter 25 removes particulate matter and dirt that may be contained in the photographic processing solution. After the photographic processing solution has been filtered, the solution enters heat exchanger 26.

Sensor 27 senses the temperature of the solution and transmits the temperature of the solution to control logic 29 via wire 28. For example, control logic 29 is the series CN 310 solid state temperature controller manufactured by Omega Engineering, Inc. of 1 Omega Drive, Stamford, Conn. 06907. Logic 29 compares the solution temperature sensed by sensor 27 and the temperature that exchanger 26 transmitted to logic 29 via wire 8. Logic 29 will inform exchanger 26, via wire 9 to add or remove heat from the solution. Thus, logic 29 and heat exchanger 26 modify the temperature of the solution and maintain the solution temperature at the desired level.

At this point the solution enters vessel 13 via inlet 4. When vessel 13 contains too much solution the excess solution will be removed by drain 14 and flow into reservoir 15. The remaining solution will circulate through space 10 and reach outlet line 6. Thereupon, the solution will pass from outlet 6 to conduit line 16 to recirculation pump 17. The photographic solution contained in the apparatus of this invention, when exposed to the photosensitive material, will reach a seasoned state more rapidly than prior art systems, because the volume of the photographic processing solution is less.

Figure 2:
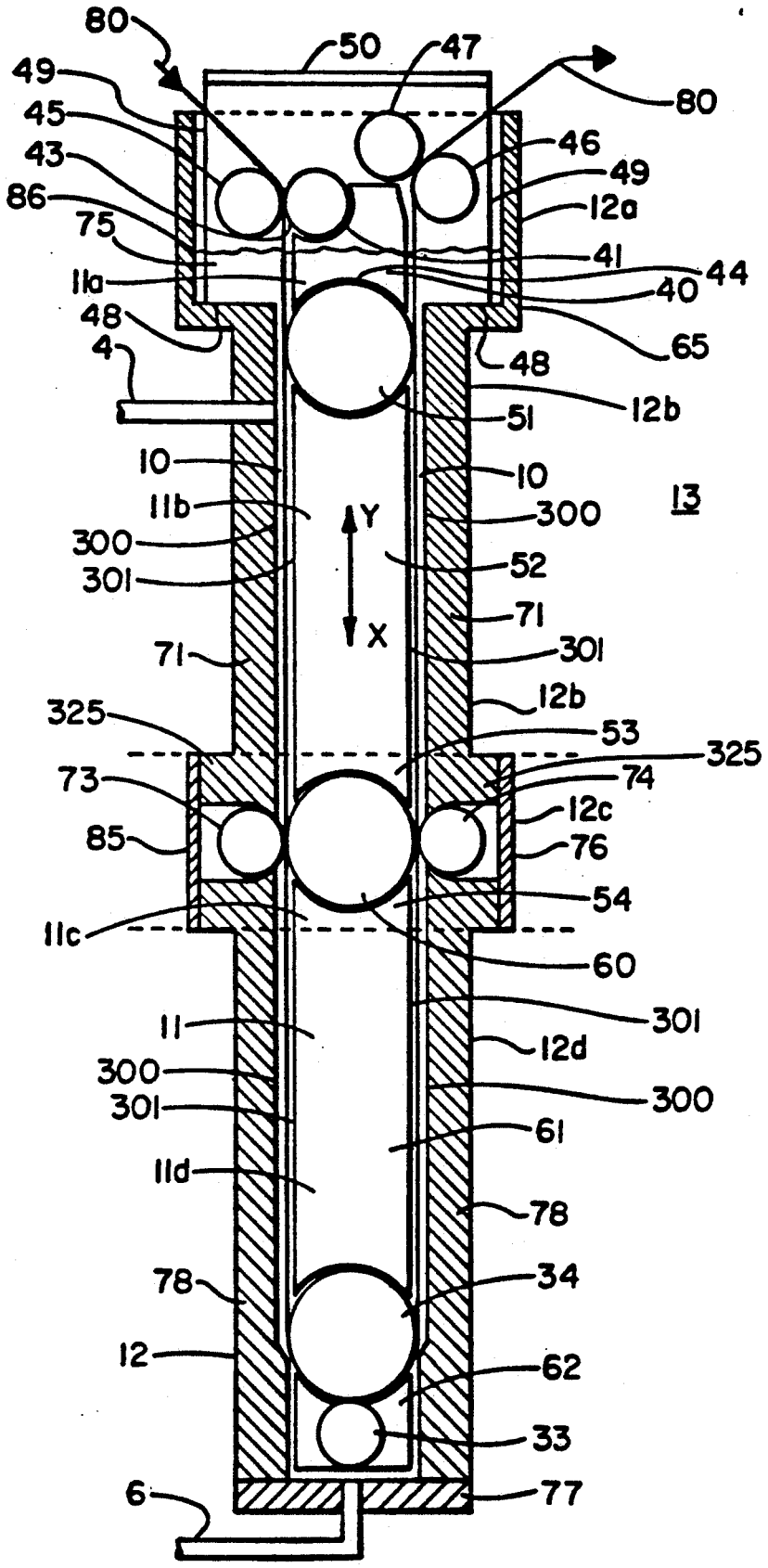
FIG. 2 is a schematic drawing showing rack 11 and tank 12 of FIG. 1 in greater detail.

FIG. 2 is a schematic diagram showing rack 11 positioned within tank 12. Handle section 11*a* of rack 11 includes a panel 40. Panel 40 has a cutout section 41 which allows driven roller 43 of rack section 11*a* to rotate in the vicinity of panel 40. Panel 40 also has a cutout section 44 which allows driven roller 51 of rack section 11*b* to rotate in the vicinity of panel 40. Driving roller 45 engages roller 43. Driving roller 46 drives driven roller 47. Rollers 46 and 47 are attached to section 11*a*. Bottom plate 48 is connected to panel 40 and side plates 49. Handle 50 is connected to side plates 49 so that an individual may be able to grasp handle 50 and move rack 11 in the direction indicated by arrow X, thereby inserting rack 11 into tank 12. This is the position shown in FIG. 2. Handle 50 may also be grasped and moved in the direction indicated by arrow Y to remove rack 11 from tank 12.

Top section 11*b* of rack 11 includes panel 52 and driving roller 51 and center section 11*c* of rack 11 includes panels 53 and 54 and driving roller 60. Bottom section 11*d* of rack 11 includes panels 61 and 62, driving roller 34 and driven roller 33.

Tank section 12*a* includes a housing section 65. Tank section 12*b* include sides 71. Tank section 12*c* includes driven rollers 73 and 74 and sides 325. Roller 73 is connected to plate 85 and driven roller 74 is connected to plate 76. Plates 85 and 76 are connected to side 325. Bottom section 12*d* of tank 12 includes bottom panel 77 and sides 78. Outlet conduit 6 passes through panel 77 and inlet conduit 4 passes through side 71.

Photosensitive material 80 may be a continuous web or cut sheets of film or photographic paper. The emulsion side of material 80 may face either rack 11 or tank 12. Material 80 passes in space 10 between rollers 45 and 43, roller 51 and side 71, rollers 73 and 60, rollers 34 and 33, rollers 60 and 74, roller 51 and side 71 and between rollers 46 and 47. Photographic processing solution 75 reaches a level 86 within tank 12. Photographic solution 75 will be contained between level 86, space 10 and photosensitive material 80. Thus, a small volume of photographic solution 75 will be on both sides of photosensitive material 80 between rack 11 and tank 12.

Rack 11 and tank 12 respectively comprise: handle sections 11*a* and 12*a*; top sections 11*b* and 12*b*; center sections 11*c* and 12*c*; and bottom sections 11*d* and 12*d*.

Tank 12 and rack 11 respectively have textured surfaces 300 and 301. The manner in which surfaces 300 and 301 function will be more fully set forth in the description of FIG. 5 and FIG. 6.

The length of rack 11 and tank 12 may be adjusted for different processing step in the photographic process. If a vessel shorter than vessel 13 of FIG. 2 is required, center rack section 11*c* and center tank section 12*c* may be respectively deleted from rack 11 and tank 12. If a longer vessel than vessel 13 of FIG. 2 is required, one or more top sections 11*b* and 12*b* and one or more center sections 11*c* and 12*c* may be respectively connected between present sections 11*c* and 12*c* and present sections 11*d* and 12*d*.

Figure 3:
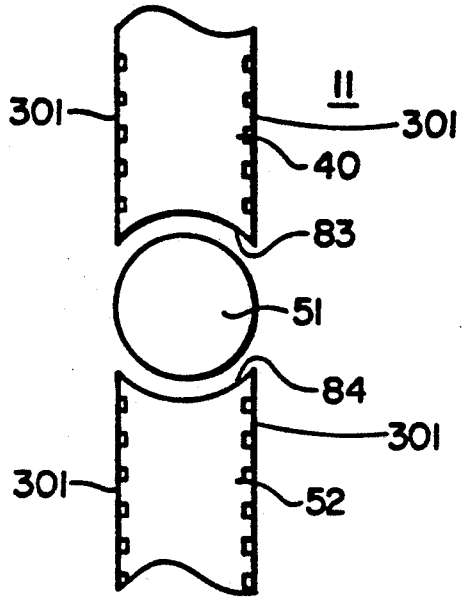
FIG. 3 is a drawing of a side view of driving roller 51 of FIG. 2.

FIG. 3 is a side view of roller 51 and textured surface 301 of rack 11. Rollers 60 and 34 are connected in a manner similar to the connection of roller 51 of FIG. 3.

Panels 40 and 52 of rack 11 respectively have curved portions 83 and 84. Portions 83 and 84 are shaped so that they will match the curvature of the outer surface of roller 51 and minimize the volume of solution 75 that will be contained between roller 51 and portions 83 and 84. Thus, the least amount of solution 75 is used to fill the voids around roller 51.

Figure 4:
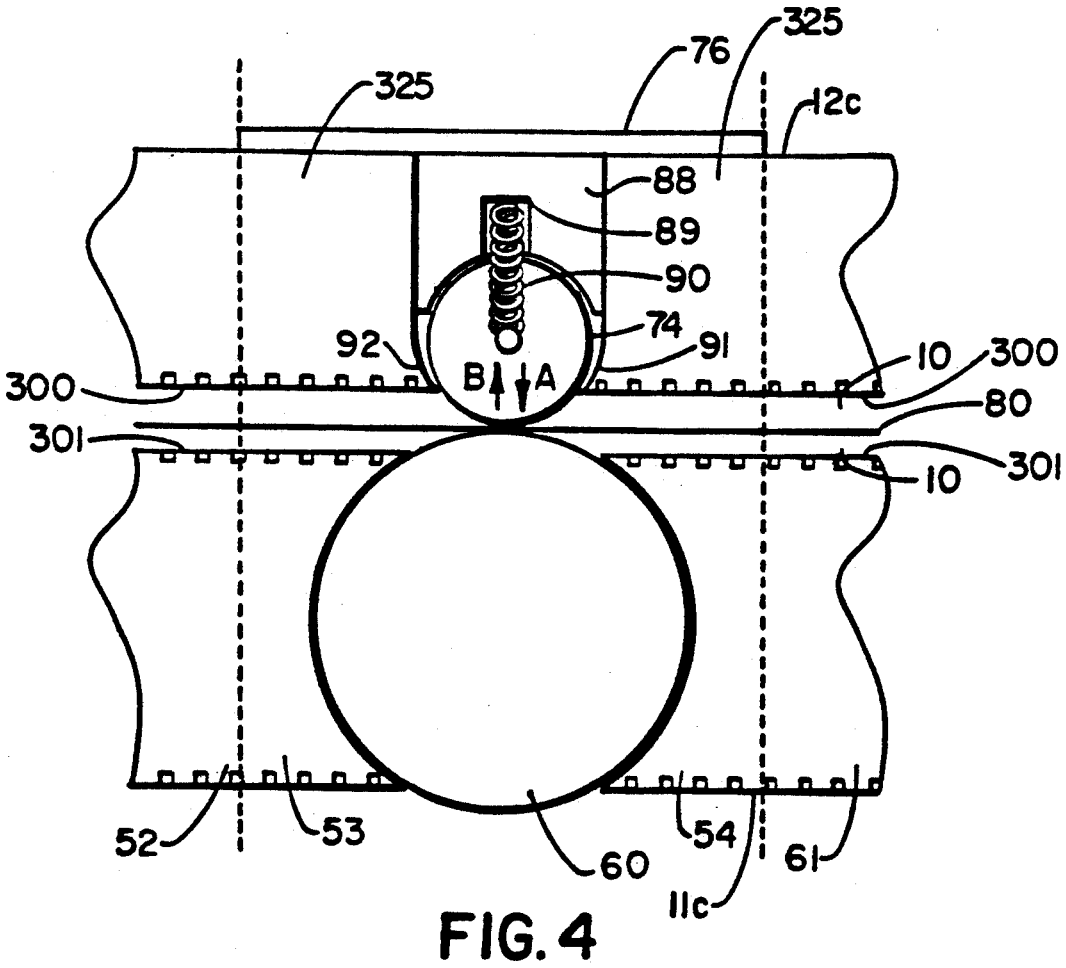
FIG. 4 is a drawing of a side view of driven roller 74 of FIG. 2.

FIG. 4 is a side view of roller 74 and roller 60 respectively of tank section 12*c* of FIG. 2. Panel 53 and panel 54 with textured surface 301 are shaped so that they will match the curvature of roller 60 and minimize the volume of solution 75 that will be contained between the shaped portions of panels 53 and 54. Panel 52 with textured surface 301 butts against panel 53 and panel 61 with textured surface 301 butts against panel 54. Roller 73 of FIG. 2 is connected in the same manner as roller 74. Retainer 88 has a notch 89. One end of spring 90 is connected to notch 89 and the other end of spring 90 is connected to the hub of roller 74. One end of plate 91 is connected to retainer 88 and the other end of plate 91 is connected to textured surface 300. One end of plate 92 is connected to retainer 88 and the other end of plate 92 is connected to textured surface 300. Plates 91 and 92 are connected to retainer 88 and surface 300 in a manner to minimize the amount of surface contact roller 74 has with space 10. Retainer 88 is connected to back plate 76 by any known fastening means, i.e., bolts, screws, etc. Plate 76 is connected to side 325 of tank section 12*c* to minimize the volume of solution 75 that exists in the voids between the above surfaces, plates, rollers and tank. Photosensitive material 80 passes between rollers 60 and 74 so that driving roller 60 may move photosensitive material 80 in space 10 between textured surfaces 300 and 301. Roller 74 is spring loaded towards back plate 87 so that roller 74 may be moved out of the way when rack 11 is seated in tank 12. When rack 11 is properly seated in tank 12 roller 74 will move in the direction shown by arrow A until it engages driving roller 60.

Figure 5:
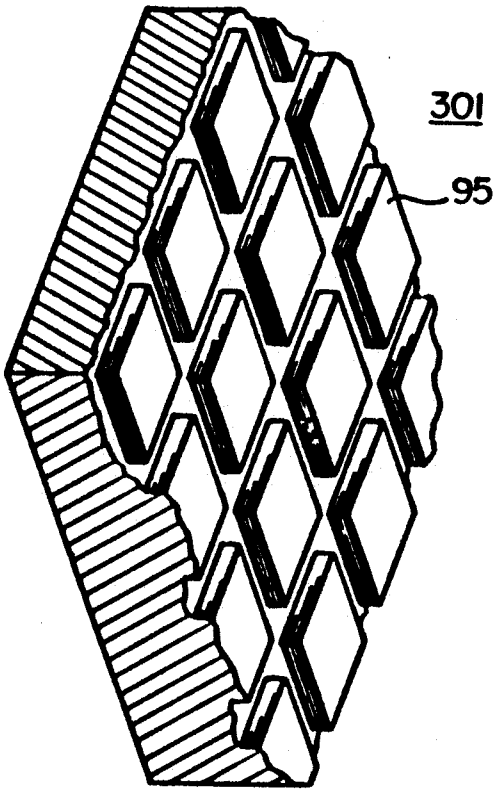
FIG. 5 is a perspective drawing of textured fluid bearing surface 301 which is affixed to rack 11 of FIG. 2.

FIG. 5 is a perspective drawing of textured fluid-bearing surface 301 which is affixed to rack 11 of FIG. 2. Textured surface 301 is textured by any known process, e.g., knurling, molded, EDM electro-discharged machined or applied. Knurls 95 are shown on surface 301. The texturing improves the flow of solution 75 between the photosensitive material 80 and rack 11. This yields a bearing of fluid aiding photosensitive material transport through rack 11. It also allows for improved circulation of solution 75 and makes it easier for particulate matter to escape direct and damaging contact with photosensitive material 80. Textured surface 301 provides space between rack 11 and space 10 to prevent particulate matter from scratching, abrading or pressure sensitizing photosensitive material 80.

Figure 6:
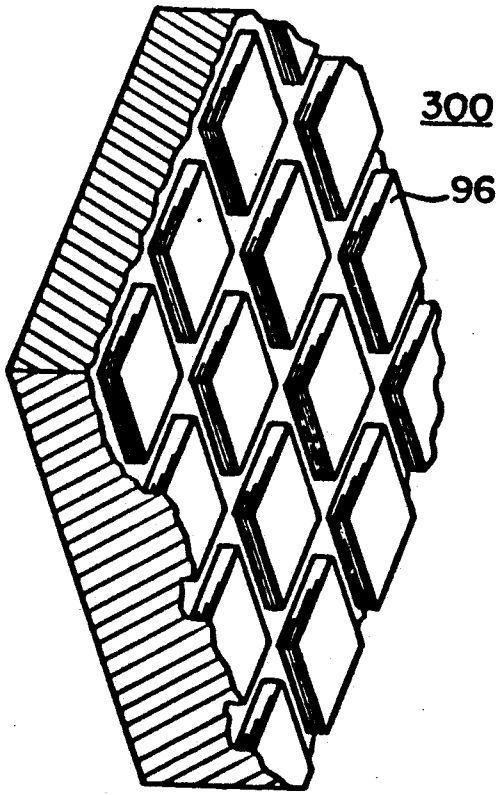
FIG. 6 is a perspective drawing of textured fluid bearing surface 300 which is affixed to tank 12 of FIG. 2.

FIG. 6 is a perspective drawing of textured fluid bearing surface 300 of tank 12. Textured surface 300 is textured by any known process, e.g., knurling, molded, EDM electro-discharged machined or applied. Knurls 96 are shown on surface 300. Texturing improves the flow of solution 75 between photosensitive material 80 and tank 12. This yields a bearing of fluid aiding photosensitive material transport through tank 12. It also allows for improved circulation of the solution 75 and makes it easier for particulate matter to escape direct and damaging contact with photosensitive material 80. Textured surface 300 provides space between tank 12 and space 10 to prevent particulate matter from scratching, abrading or pressure sensitizing photosensitive material 80.

Figures 7, 8:
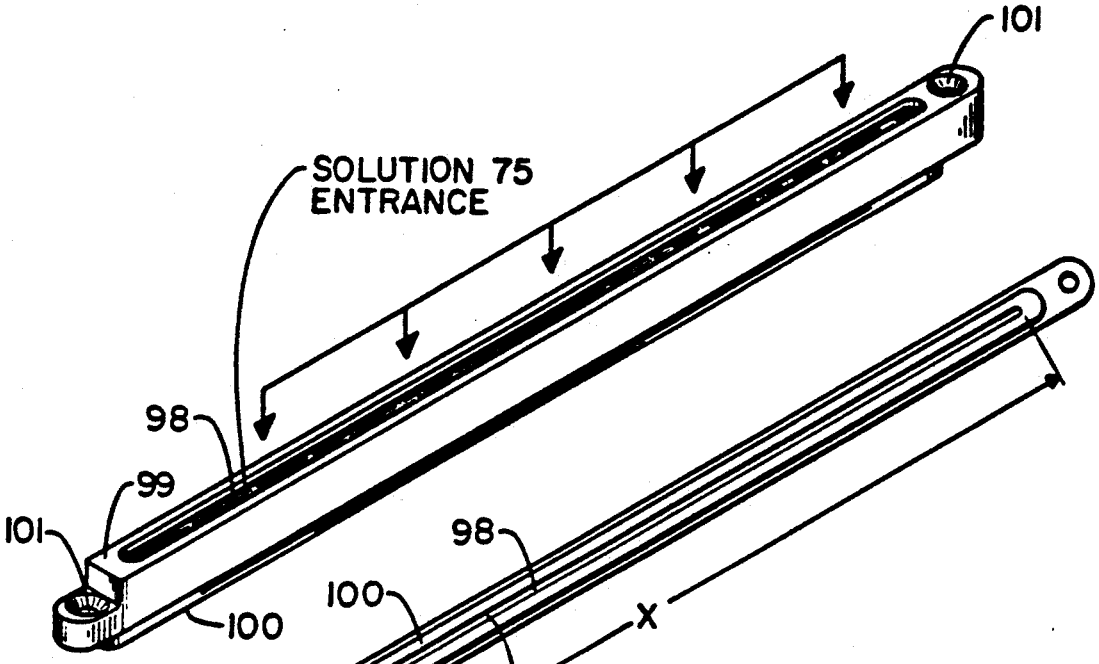
FIG. 7 is a perspective drawing of a slot nozzle.
FIG. 8 is a bottom view of the slot nozzle of FIG. 7.

FIG. 7 is a perspective drawing of slot nozzle 97. Slot 98 runs from top surface 99 of slot nozzle 97 to bottom surface 100 of slot nozzle 97. Nozzle 97 may be affixed to tank 12 or rack 11 (FIG. 2) by inserting any known fastening means, i.e., bolts, rivets, screws, etc. in orifices 101 and attaching the fastening means to tank 12 or rack 11. Surface 100 will be coincident with the inside wall of tank 12. Processing solution 75 will enter slot 98 near top surface 99 and exit slot 98 near bottom surface 100.

FIG. 8 is a bottom view of slot nozzle 97 of FIG. 7. Slot 98 will distribute fresh processing solution along width x. Width x will be wider than the width of photosensitive material 80. The depth or thickness y of slot 98 is such that y/x (100) is less than 1.

Figure 9:
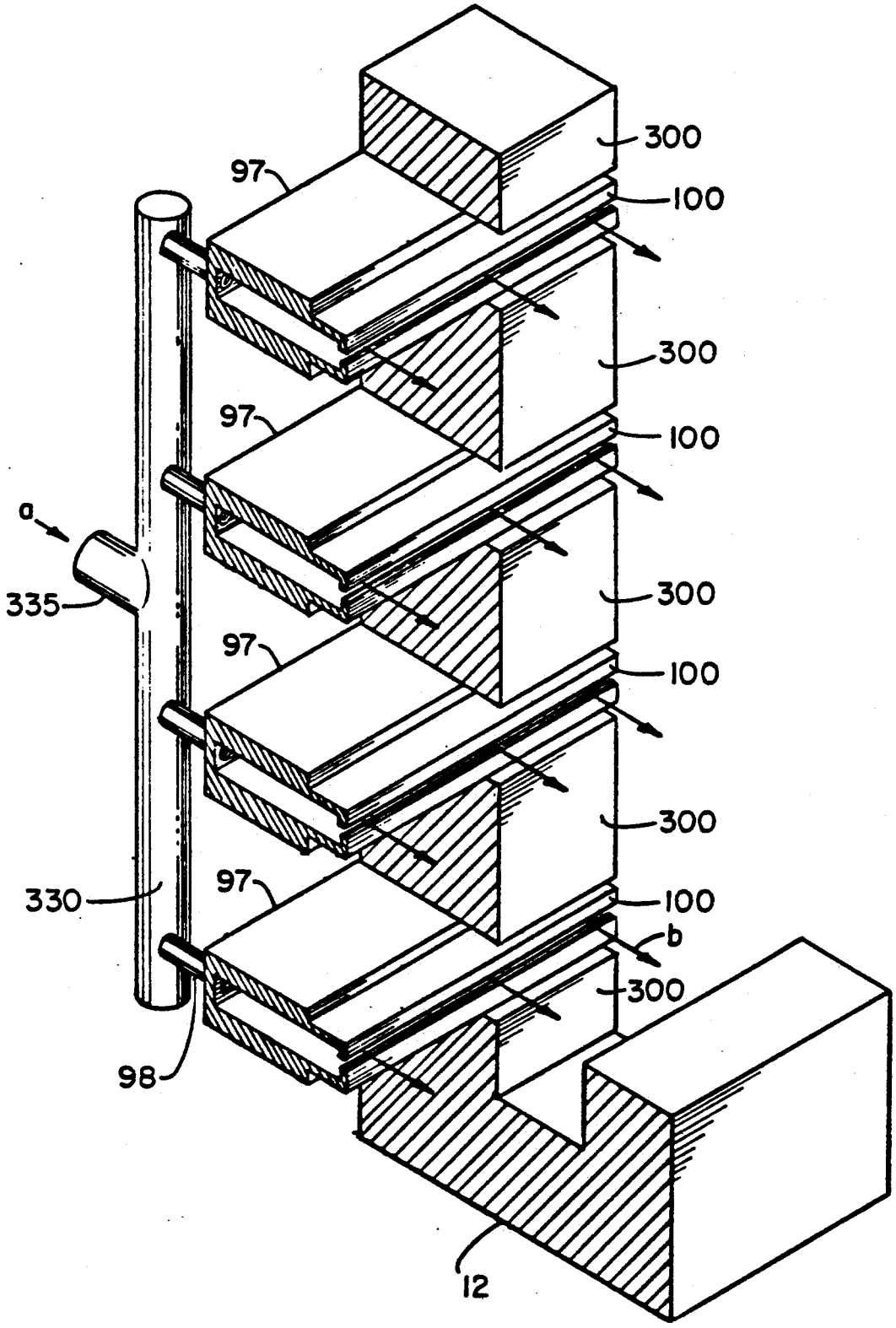
FIG. 9 is a perspective drawing of a plurality of slot nozzles in a processing tank.

FIG. 9 is a perspective drawing of a plurality of slot nozzles 97 in processing tank 12. Nozzle 97 is connected to tank 12 in such a manner that surface 100 will be coincident with the inner wall of textured surface 300 of tank 12. Fresh processing solution 75 will enter port 335 and conduit 330 of nozzle 97 in the direction indicated by arrow a and exit nozzle 97 in the direction indicated by arrow b.

To achieve the desired photographic reaction between the processing solution and the surface of the photosensitive material the position and quantity of nozzles 97 may be varied by one skilled in the art.

Figure 10:
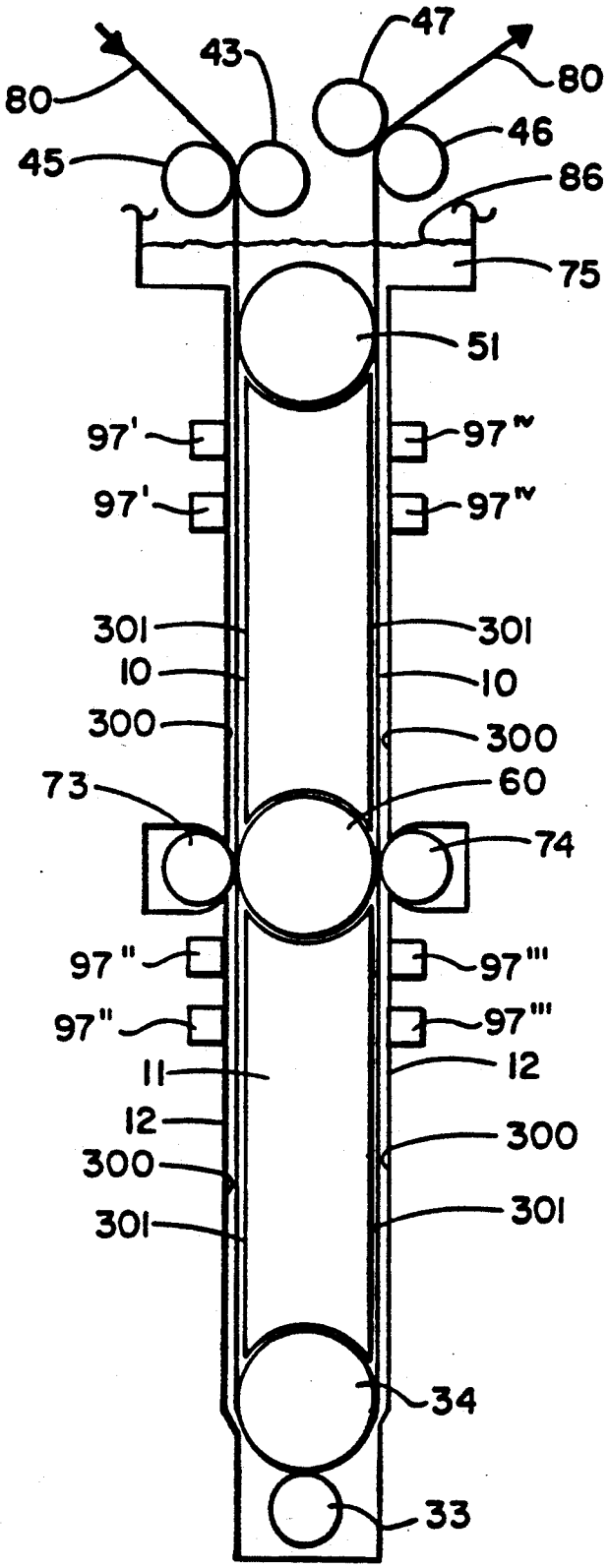
FIG. 10 is a side view of a plurality of slot nozzles affixed to the wall of a processing tank.

FIG. 10 is a side view of a plurality of slot nozzles 97 positioned within tank 12. Surface 100 (not shown) of slot nozzles 97 are coincident with the inner wall of textured surface 300 of tank 12.

Photosensitive material 80 may be a continuous web or cut sheets of film or photographic paper. The emulsion side of material 80 may face either rack 11 or tank 12. Material 80 passes in space 10 between roller 45 and 43, roller 51, rollers 73 and 60, rollers 34 and 33, rollers 60 and 74, roller 51 and between rollers 46 and 47. Photographic processing solution 75 reaches a level 86 within tank 12. Photographic solution 75 will be contained between level 86, space 10 and photosensitive material 80. Thus, a small volume of photographic solution 75 will be on both sides of photosensitive material 80 between rack 11 and tank 12.

Slot nozzles 97' are positioned in the wall of tank 12 below rollers 43, 45 and 51. Nozzles 97' are removable for servicing or replacement. As photosensitive material 80 is processed, a boundary layer of exhausted processing solution forms in space 10 between material 80 and the wall of tank 12. The boundary layer of exhausted solution is broken up by fresh processing solution 75 that is delivered to material 80 by slot nozzles 97'.

Slot nozzles 97'' are positioned in the wall of tank 12 below rollers 73 and 60. Nozzles 97'' are removable for servicing or replacement. As photosensitive material 80 is processed, a boundary layer of exhausted processing solution forms in space 10 between material 80 and the wall of tank 12. The boundary layer of exhausted solution is broken up by fresh processing solution 75 that is delivered to material 80 by slot nozzles 97''.

Slot nozzles 97''' are positioned in the wall of tank 12 below rollers 74 and 60 and above rollers 33 and 34. Nozzles 97''' are removable for servicing or replacement. As photosensitive material 80 is processed, a boundary layer of exhausted processing solution forms in space 10 between material 80 and the wall of tank 12. The boundary layer of exhausted solution is broken up by fresh processing solution 75 that is delivered to material 80 by slot nozzles 97'''.

Slot nozzles 97$^{iv}$ are positioned in the wall of tank 12 below rollers 46, 47 and 51. As photosensitive material 80 is processed, a boundary layer of exhausted processing solution forms in space 10 between material 80 and the wall of tank 12. Nozzles 97$^{iv}$ are removable for servicing or replacement. The boundary layer of exhausted solution is broken up by fresh solution 75 that is delivered to material 80 by slot nozzle 97$^{iv}$.

Figure 11:
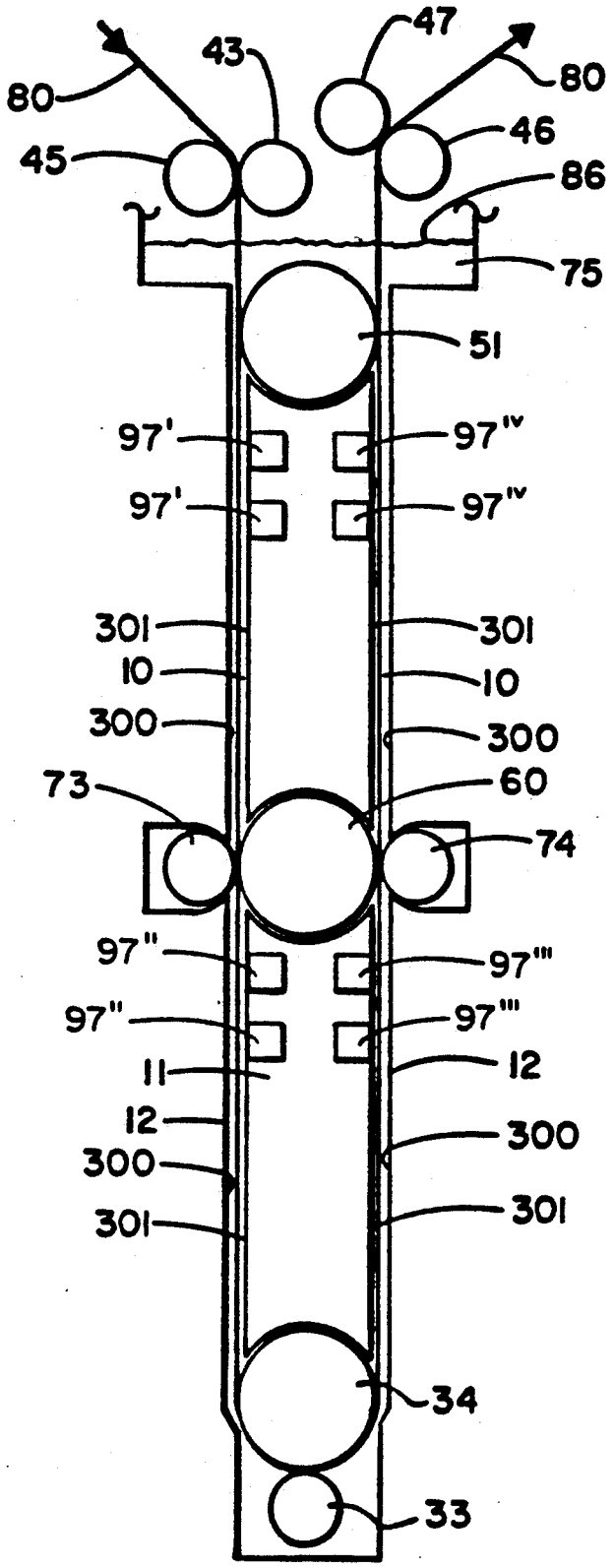
FIG. 11 is a side view of a plurality of slot nozzles affixed to the wall of a rack.

FIG. 11 is a side view of a plurality of slot nozzles 97 positioned within rack 11. Surface 100 (not shown) of slot nozzles 97 are coincident with the inner wall of textured surface 301 of rack 11.

Photosensitive material 80 may be a continuous web or cut sheets of film or photographic paper. The emulsion side of material 80 may face either rack 11 or tank 12. Material 80 passes in space 10 between rollers 45 and 43, roller 51, rollers 73 and 60, rollers 34 and 33, rollers 60 and 74, roller 51 and between rollers 46 and 47. Photographic processing solution 75 reaches a level 86 within tank 12. Photographic solution 75 will be contained between level 86, space 10 and photosensitive material 80. Thus, a small volume of photographic solution 75 will be on both sides of photosensitive material 80 between rack 11 and tank 12.

Slot nozzles 97' are positioned in the wall of rack 11 below rollers 43, 45 and 51. As photosensitive material 80 is processed, a boundary layer of exhausted processing solution forms in space 10 between material 80 and the wall of rack 11. The boundary layer of exhausted solution is broken up by fresh solution 75 that is delivered to material 80 by slot nozzles 97'.

Slot nozzles 97'' are positioned in the wall of rack 11 below rollers 73 and 60. As photosensitive material 80 is processed, a boundary layer of exhausted processing solution forms in space 10 between material 80 and the wall of rack 11. The boundary layer of exhausted solution is broken up by fresh solution 75 that is delivered to material 80 by slot nozzles 97''.

Slot nozzles 97''' are positioned in the wall of rack 11 below rollers 74 and 60 and above rollers 33 and 34. As photosensitive material 80 is processed, a boundary layer of exhausted processing solution forms in space 10 between material 80 and the wall of rack 11. The boundary layer of exhausted solution is broken up by fresh solution 75 that is delivered by material 80 by slot nozzle 97'''.

Slot nozzles 97$^{iv}$ are positioned in the wall of rack 11 below rollers 46, 47 and 51. As photosensitive material 80 is processed, a boundary layer of exhausted processing solution forms in space 10 between material 80 and the wall of rack 11. The boundary layer of exhausted solution is broken up by fresh solution 75 that is delivered to material 80 by slot nozzle 97$^{iv}$.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

What is claimed is:

1. An apparatus for processing photosensitive materials, which comprises:

a tank through which a processing solution is pumped;

a rack having integral means to facilitate its insertion and removal from said tank, said rack and said tank are relatively dimensioned so that a small volume for holding processing solution and photosensitive material is formed between said rack and said tank;

means for circulating the processing solution through the small volume; and one or more slot nozzles coupled to said circulating means and located in the wall of said tank for controlling the velocity and amount of processing solution that dynamically impinges on the surface of the photosensitive material, wherein the width of said one or more slot nozzles is such that the processing solution exiting said one or more slot nozzles is wider than the width of the photosensitive material.

2. The apparatus claimed in claim 1, wherein the ratio of the length to the width of said slot nozzle is such that the processing solution will rapidly and uniformly exit said slot nozzle.

3. The apparatus claimed in claim 1, wherein said circulation means comprises:

a pump for recirculating the processing solution;

conduits connected to said pump, said rack and said tank for transporting the processing solution; and a filter connected to said conduit for removing particulate matter from the processing solution, wherein the processing solution volume contained in said pump, said conduits and said filter does not exceed the small volume for holding processing solution.

4. The apparatus claimed in claim 1, further including:

a plurality of metering pumps for metering specified amounts of chemicals; and a manifold coupled to said conduit and said metering pumps for dispensing additional processing solution to the small volume.

5. An apparatus for processing photosensitive materials, which comprises:

a tank through which a processing solution is pumped;

a rack having integral means to facilitate its insertion and removal from said tank, said rack and said tank are relatively dimensioned so that a small volume for holding processing solution and photosensitive material is formed between said rack and said tank;

means for circulating the processing solution through the small volume; and one or more slot nozzles coupled to said circulating means and located in the wall of said rack for controlling the velocity and amount of processing solution that dynamically impinges on the surface of the photosensitive material.

6. The apparatus claimed in claim 5, wherein the width of said slot nozzle is such that the processing solution exiting said slot nozzle is wider than the width of the photosensitive material.

7. The apparatus claimed in claim 5, wherein the ratio of the length to the width of said slot nozzle is such that the processing solution will rapidly and uniformly exit said slot nozzle.

8. The apparatus claimed in claim 5, wherein said circulation means comprises:

a pump for recirculating the processing solution;

conduits connected to said pump, said rack and said tank for transporting the processing solution; and a filter connected to said conduit for removing particulate matter from the processing solution, wherein the processing solution volume contained in said pump, said conduits and said filter does not exceed the small volume for holding processing solution.

9. The apparatus claimed in claim 5, further including:

a plurality of metering pumps for metering specified amounts of chemicals; and a manifold coupled to said conduit and said metering pumps for dispensing additional processing solution to the small volume.

10. The apparatus claimed in claim 9, wherein said tanks have an overflow conduit coupled to a reservoir to maintain a consistent processing solution level.

11. A method for adjusting the chemical reaction in a small volume rack and tank photographic processing apparatus between the processing solution and the surface of a photosensitive material by controlling the amount of fresh processing solution that reaches the surface of the photosensitive material through a boundary layer that includes exhausted processing solution, which comprises:

a) controlling the velocity of processing solution impinging on the surface of the photosensitive material through the boundary layer; and b) controlling the amount of processing solution impinging on the surface of the photosensitive material through the boundary layer, whereby additional processing solution penetrates the boundary layer, wherein the area that the processing solution covers is wider than the surface of the photosensitive material so that a uniform chemical reaction will take place between the processing solution and the photosensitive material.

* * * * *